US009599935B2

(12) United States Patent
Asai et al.

(10) Patent No.: US 9,599,935 B2
(45) Date of Patent: Mar. 21, 2017

(54) IMAGE FORMING APPARATUS WITH CLEANING USING CLEANING MEMBER AND CHARGING MEMBER

(71) Applicant: CANON KABUSHIKI KAISHA, Tokyo (JP)

(72) Inventors: Masanori Asai, Tokyo (JP); Kazuhiro Funatani, Mishima (JP); Hiroyuki Seki, Suntou-gun (JP); Shuji Saito, Suntou-gun (JP); Yasutaka Yagi, Mishima (JP); Tetsuichiro Fujimoto, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/007,597

(22) Filed: Jan. 27, 2016

(65) Prior Publication Data

US 2016/0223932 A1 Aug. 4, 2016

(30) Foreign Application Priority Data

Jan. 29, 2015 (JP) ..... 2015-015804

(51) Int. Cl.
*G03G 15/16* (2006.01)
*G03G 21/00* (2006.01)

(52) U.S. Cl.
CPC ..... *G03G 15/161* (2013.01); *G03G 21/0076* (2013.01); *G03G 2215/0132* (2013.01); *G03G 2221/001* (2013.01)

(58) Field of Classification Search
CPC . G03G 15/0283; G03G 15/161; G03G 15/168
See application file for complete search history.

(56) References Cited

U.S. PATENT DOCUMENTS

| | | | |
|---|---|---|---|
| 9,075,352 | B2 | 7/2015 | Seki et al. |
| 9,086,671 | B2 | 7/2015 | Ichinose et al. |
| 2009/0232530 | A1 | 9/2009 | Saito et al. |

(Continued)

FOREIGN PATENT DOCUMENTS

| | | | |
|---|---|---|---|
| JP | 2000-131920 | A | 5/2000 |
| JP | 2009-205012 | A | 9/2009 |
| JP | 2009-288481 | A | 12/2009 |

OTHER PUBLICATIONS

U.S. Appl. No. 14/833,255, filed Aug. 24, 2015.

*Primary Examiner* — Sandra Brase
(74) *Attorney, Agent, or Firm* — Fitzpatrick, Cella, Harper & Scinto

(57) ABSTRACT

In an adjustment step, an adjustment purpose toner image is formed on an intermediate transfer belt, and the adjustment purpose toner image is removed from the intermediate transfer belt by a cleaning member contacting the intermediate transfer belt and through an electrostatic cleaning step. This adjustment step is executed in a state where a toner attachment amount on a charging member is switched from a first limit value, which is allowed in the image forming step to a second limit value, which is allowed immediately before executing the adjustment step. This switching is performed by the execution of a toner discharging step, where a power supply changes the state of applying voltage to the charging member from that in the electrostatic cleaning step, so that toner attached to the charging member is transferred to the intermediate transfer belt.

15 Claims, 12 Drawing Sheets

(56) References Cited

U.S. PATENT DOCUMENTS

| | | | | |
|---|---|---|---|---|
| 2012/0008973 | A1* | 1/2012 | Sakakibara | G03G 15/161 399/71 |
| 2014/0064769 | A1* | 3/2014 | Sugiura | G03G 21/0035 399/71 |
| 2014/0105643 | A1 | 4/2014 | Saito et al. | |
| 2014/0119759 | A1* | 5/2014 | Yamaura | G03G 15/168 399/66 |
| 2015/0093143 | A1 | 4/2015 | Funatani et al. | |

* cited by examiner

PRIOR ART

PRIOR ART

IMAGE FORMING APPARATUS WITH CLEANING USING CLEANING MEMBER AND CHARGING MEMBER

BACKGROUND OF THE INVENTION

Field of the Invention

The present invention relates to an image forming apparatus using an electro-photographic system or an electrostatic recording system.

Description of the Related Art

In an image forming apparatus that uses an electrophotographic system or an electrostatic recording system, such as a copier and printer, an intermediate transfer system, which transfers a toner image formed on a photoreceptor to an intermediate transfer belt (primary transfer) and then transfers the toner image from the intermediate transfer belt to a transfer material (recording material) (secondary transfer) so as to output the image, is known. For the intermediate transfer belt, an endless belt type intermediate transfer belt is widely used. The methods used for cleaning the residual toner on the intermediate transfer belt are roughly classified into: a blade cleaning system; an electrostatic cleaning system; and a hybrid system which uses both of these systems.

The blade cleaning system (Japanese Patent Application Laid-Open No. 2009-288481) is a method of physically scraping off the residual toner on the intermediate transfer belt using a cleaning belt that is contacting the intermediate transfer belt. In the case of this cleaning system, a good cleaning performance can be expected at low cost, but a disadvantage is that the blade wears out due to long time use and is easily influenced by unevenness on the surface of the intermediate transfer belt, which makes it difficult to maintain a good cleaning performance for a long period of time.

In the case of the electrostatic cleaning system (Japanese Patent Application Laid-Open No. 2009-205012), the residual toner is charged to the reversed polarity state of the charged state at development using the charging unit to which voltage is applied. Then the residual toner charged to the reversed polarity is transferred back from the intermediate transfer belt to the photoreceptor in the next primary transfer step, and is collected by the cleaning unit which cleans the photoreceptor. This system is therefore called a "simultaneous transfer-and-cleaning system".

An advantage of the electrostatic cleaning system is that cleaning is not affected very much by unevenness on the surface of the intermediate transfer belt, but if images are continuously formed, toner is deposited on the charging unit, and this toner must be cleared to maintain cleaning performance. To clean the charging unit in the electrostatic cleaning system, the attached toner is discharged from the charging unit by applying voltage having the same polarity as the toner, and collecting the discharged toner to the photoreceptor. Since the charging polarity of the toner immediately after the discharge is reversed polarity of the primary transfer voltage, the discharged toner cannot be collected to the photoreceptor by the primary transfer unit immediately after the discharge. Hence the discharged toner must be charged to the same polarity as the primary toner voltage by the charging unit again by the step of further rotating the intermediate transfer belt. This means that time to rotate the intermediate transfer belt is required only for this discharging step.

In the case of the hybrid type cleaning method (Japanese Patent Application Laid-Open No. 2000-131920), most of the residual toner on the intermediate transfer belt is removed by a cleaning blade disposed downstream of the secondary transfer unit in the rotation direction of the intermediate transfer belt. Residual toner that passed by the cleaning blade is charged by a charging unit, such as a conductive brush, disposed downstream of the cleaning blade in the rotation direction of the intermediate transfer belt, whereby simultaneous transfer-and-cleaning to the photoreceptor is performed. In this hybrid system, cleaning can be assisted by the charging unit, as mentioned above, even if the blade wears out by long time usage. Further, for the cleaning of the charging member, attached toner is discharged in the same manner as the electrostatic cleaning system and the discharged toner can be collected by the cleaning blade, hence the rotating time of the intermediate transfer belt decreases. As a consequence, the cleaning method of the hybrid system can implement: a shorter processing time (downtime) than the electrostatic cleaning method; and a better cleaning performance for a long period of time than the blade cleaning system.

SUMMARY OF THE INVENTION

In the above mentioned hybrid system, there is little toner attached to the charging unit, since most of the toner on the intermediate transfer belt is scraped off by the cleaning blade, hence the charging unit can be cleaned less frequently compared with the conventional electrostatic cleaning system. However if images are continuously formed, toner would gradually build up on the charging unit, and charging capability would drop. If cleaning of this charging unit is insufficient, good cleaning performance may not be acquired when a large amount of toner remaining on the intermediate transfer belt is processed after calibration. Calibration is an image forming process to create a detection image on the intermediate transfer belt, for such purpose as adjusting the printing position of each color on the intermediate transfer belt. In other words, the detection image created on the intermediate transfer belt during calibration is not an image to be transferred to the recording material, but which must be removed by the cleaning unit. Therefore the charging unit must be cleaned sufficiently in order to process the large amount of residual toner that remains as the detection image. On the other hand, in order to clean the charging unit to the level of acquiring good cleaning performance during calibration and to maintain that level, time to perform the cleaning step increases and downtime increases.

It is an object of the present invention to provide a technique to reduce downtime in an image forming apparatus that can execute the cleaning of the intermediate transfer belt by the hybrid system, while maintaining good cleaning performance.

To achieve the above object, an image forming apparatus of the present invention includes:

an image bearing member configured to bear a toner image that is formed by an electrostatic latent image being developed using toner;

an intermediate transfer belt configured such that a toner image is transferred from the image bearing member;

a cleaning member configured to remove toner from the intermediate transfer belt by contacting the intermediate transfer belt;

a charging member configured to charge toner borne on the intermediate transfer belt; and a power supply configured to apply voltage, which is required for the charging member to charge toner, to the charging member, wherein the image forming apparatus can execute:

an image forming step in which an image is formed on a recording material by transferring a toner image, which is transferred from the image bearing member to the intermediate transfer belt, to the recording material;

an electrostatic cleaning step in which the power supply applies voltage, which has reversed polarity of the polarity used upon charging toner to develop an electrostatic latent image, to the charging member, and the charging member charges the toner borne on the intermediate transfer belt to have the reversed polarity so that the toner is transferred from the intermediate transfer belt to the image bearing member, and the toner is removed from the intermediate transfer belt;

a toner discharging step in which the power supply changes a state of applying voltage to the charging member from that in the electrostatic cleaning step, so that the toner attached to the charging member is transferred to the intermediate transfer belt; and an adjustment step in which an adjustment-purpose toner image, which is not transferred to a recording material, is formed on the intermediate transfer belt, and the adjustment-purpose toner image is removed from the intermediate transfer belt by the cleaning member and through the electrostatic cleaning step, wherein the adjustment step is executed in a state where a toner attachment amount of the charging member is switched from a first limit value, which is allowed in the image forming step, to a second limit value, which is allowed immediately before executing the adjustment step, by the execution of the toner discharging step.

According to the present invention, in an image forming apparatus that can execute the cleaning of the intermediate transfer belt by the hybrid system, downtime can be reduced while maintaining good cleaning performance.

Further features of the present invention will become apparent from the following description of exemplary embodiments with reference to the attached drawings.

DESCRIPTION OF THE EMBODIMENTS

Embodiments of the present invention will now be described in detail based on examples with reference to the drawings. The dimensions, materials, shapes and relative dispositions or the like of the components described in the embodiments may need to be appropriately changed depending on the configuration and various conditions of the apparatus to which the present invention is applied. In other words, the scope of the invention is not limited to the following embodiments.

Example 1

1. General Configuration of Image Forming Apparatus

Figure 2:
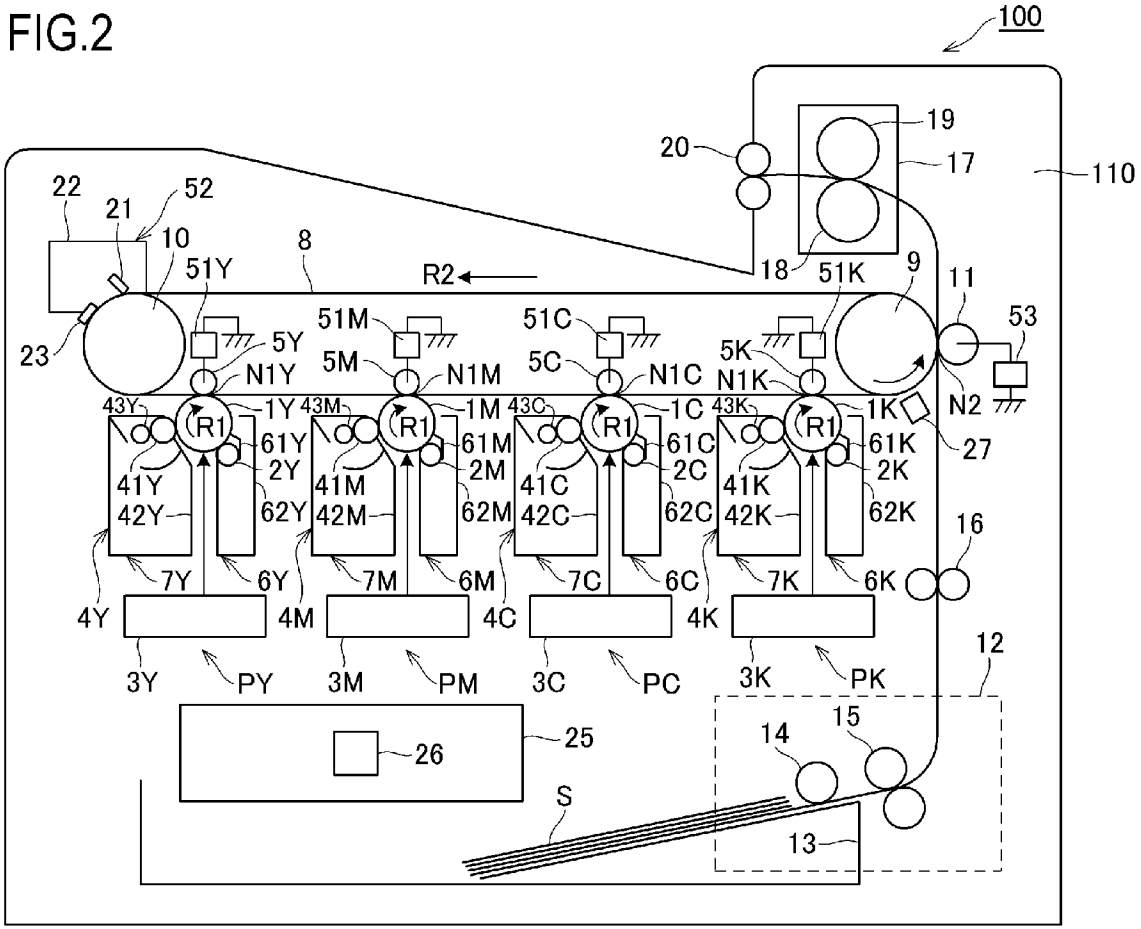
FIG. 2 is a schematic cross-sectional view of an image forming apparatus according to an example of the present invention.

FIG. 2 is a schematic cross-sectional view of an image forming apparatus according to an example of the present invention. The image forming apparatus 100 of this example is a tandem type image forming apparatus based on an intermediate transfer system which forms a full color image using an electro-photographic system. The image forming apparatus 100 has a plurality of image forming units P, that is first, second, third and fourth image forming units PY, PM, PC and PK. The first, second, third and fourth image forming units PY, PM, PC and PK form toner images of yellow (Y), magenta (M), cyan (C) and black (K) respectively. In this example, the configuration and operation of each image forming unit PY, PM, PC and PK are essentially the same, except that the color of toner to be used is different. Therefore unless a distinction is necessary, Y, M, C or K, to indicate the color element in each reference symbol, will be omitted in the following description.

The image forming unit P includes a drum type electrophotographic photoreceptor (photoreceptor), that is, a photosensitive drum 1, as an image bearing member. The photosensitive drum 1 is rotary-driven by a driving unit (not illustrated) in the arrow R1 direction in FIG. 2. A primary charging roller 2 used as a primary charging unit constituted by a roller type charging member, an exposure apparatus (laser unit) 3 used as an exposure unit (image writing unit) and a developing assembly 4 used as a developing unit are disposed around the photosensitive drum 1 along the rotating direction of the photosensitive drum 1. Thereafter a primary transfer roller 5 used as a primary transfer unit constituted by a roller type charging member, and a drum cleaner 6 used as a photoreceptor cleaning unit are disposed respectively.

The developing assembly 4 has a developing roller 41 used as a developer bearing member, a toner container (developer container) 42 that contains toner used as the developer, and a supply roller 43 that supplies the developer to the developing roller. The drum cleaner 6 has a drum cleaning blade 61 used as a cleaning unit, and a waste toner container 62. The intermediate transfer belt 8 used as an intermediate transfer member is stretched by a driver roller 9 and a tension roller 10, and is rotary-driven in the arrow direction R2 in FIG. 2, by transferring the drive force to the driver roller 9.

The primary transfer roller 5 is pressed against the photosensitive drum 1 via the intermediate transfer belt 8, and the intermediate transfer belt 8 and the photosensitive drum 1 are contacted, whereby a primary transfer unit (primary transfer nip) N1 is formed. In this example, the photosensitive drums 1Y, 1M, 1C and 1K and the primary transfer rollers 5Y, 5M, 5C and 5K can be contacted/separated via the intermediate transfer belt 8. Because of the configuration that allows contact and separation, the primary transfer rollers 5Y, 5M, 5C and 5K can be contacted with/separated from the photosensitive drums 1Y, 1M, 1C and 1K across the intermediate transfer belt 8.

A secondary transfer roller 11 used as a secondary transfer unit constituted by a roller type charging member is disposed on the outer peripheral surface of the intermediate transfer belt 8 in a position facing the driver roller 9. The secondary transfer roller 11 is pressed against the driver roller 9 via the intermediate transfer belt 8, and the intermediate transfer belt 8 and the secondary transfer roller 11 are contacted, whereby a secondary transfer unit (secondary transfer nip) N2 is formed. A color shift detection sensor 27, which is an optical sensor, detects a calibration-purpose toner pattern formed on the intermediate transfer belt 8. The color shift detection sensor 27 is disposed near the driver roller 9.

Further, a belt cleaner 52 used as an intermediate transfer belt cleaning unit is disposed on the outer peripheral surface of the intermediate transfer belt 8 in a position facing the tension roller 10. The belt cleaner 52 has a belt cleaning blade 21 used as a contact member, a conductive brush 23 used as a charging unit (charging member), and a waste toner container 22.

In each image forming unit P according to this example, the photosensitive drum 1, and the charging roller 2, the developing assembly 4 and the drum cleaner 6 which are used as processing units operating on the photosensitive drum 1, are integrated and constitute a process cartridge 7. Each process cartridge 7Y, 7M, 7C and 7K is detachable from the apparatus main body 110 of the image forming apparatus 100. In this example, the configuration of each process cartridge 7Y to 7K is essentially the same, except that the toner contained in each toner container 42Y, 42M, 42C and 42K is toner corresponding to each color: yellow (Y), magenta (M), cyan (C) and black (K).

In the image forming apparatus 100, a control board 25, on which electric circuits to control the image forming apparatus 100 is disposed, is provided. The control board 25 includes a CPU 26 used as a control unit. The control board 25 controls the operation of the apparatus based on signals from various sensors (not illustrated) in the apparatus, and collectively controls operations of the image forming apparatus 100 related to the image formation in general.

2. Transfer Configuration

The configuration related to the primary transfer and the secondary transfer according to this example will be described next in detail. In this example, the intermediate transfer belt 8, which can easily be downsized, is used as the intermediate transfer member. The intermediate transfer belt 8 is an endless belt of which conductivity is implanted by adding a conductive agent to a resin material. The intermediate transfer belt 8 is stretched by two axes of the driver roller 9 and the tension roller 10, and a total of 100 N tension is applied by the tension roller 10.

For the intermediate transfer belt 8 of this example, a 70 μm thick endless belt made of polyimide resin, of which volume resistivity has been adjusted to $1\times10^{10}$ Ω·cm by mixing carbon as the conducting agent, is used. The intermediate transfer belt 8 has electronic conductivity as an electric characteristic, and the fluctuation of the electric resistivity thereof with respect to atmospheric temperature and humidity is small. The range of the volume resistivity of the intermediate transfer belt 8 is preferably $1\times10^{9}$ to $10^{11}$ Ω·cm in terms of transferability. If the volume resistivity is lower than $10\times10^{9}$ Ω·cm, then faulty transfer may occur when the transfer current is released from the secondary transfer nip in the surface direction of the intermediate transfer belt 8 under a high temperature high humidity environment. If the volume resistivity is higher than $1\times10^{11}$ Ω·cm, then faulty transfer may occur due to an abnormal discharge under a low temperature low humidity environment.

The volume resistivity of the intermediate transfer belt 8 is determined by the following measurement method. That is, by using Mitsubishi Chemical Corporation's Hiresta-UP (MCP-HT450) (a measurement probe: UR), measurement is performed under the following conditions: measurement temperature: room temperature of 23° C.; measurement humidity: room humidity of 50%; applied voltage: 250 V; and measurement time: 10 sec. In this example, polyimide resin is used as the material of the intermediate transfer belt 8, but the material of the intermediate transfer belt 8 is not limited to this. For example, another thermoplastic resin material may be used, such as: polyester, polycarbonate, polyarylate, acrylonitrile-butadiene-styrene copolymer (ABS), polyphenylene sulfide (PPS), polyvinylidene fluoride (PVdF) and polyethylene naphthalate (PEN). A mixed resin thereof may be used as well.

For the primary transfer roller 5, an elastic roller (outer dimension: 12 mm), which is created by covering a nickel plated steel rod (outer diameter: 6 mm) as a core bar with a 3 mm thick foamed sponge body as an elastic layer, is used. The main components of this foamed sponge are acrylonitrile-butadiene rubber (NBR) and epichlorohydrin rubber, of which volume resistivity has been adjusted to $1\times10^{7}$ Ω·cm. The primary transfer roller 5 contacts the photosensitive drum 1 via the intermediate transfer belt 8 at a 9.8 N pressing force, and rotates in tandem with the rotation of the intermediate transfer belt 8. When the toner on the photosensitive drum 1 is being primary-transferred to the intermediate transfer belt 8, 1500 V of DC voltage (primary transfer voltage) is applied to the primary transfer roller 5.

For the secondary transfer roller 11, an elastic roller (outer diameter: 18 mm), which is created by covering a nickel plated steel rod (outer diameter: 8 mm) as a core bar with a 5 mm thick foamed sponge body as an elastic layer, is used. The main components of this foamed sponge are acrylonitrile-butadiene rubber (NBR) and epichlorohydrin rubber, of which volume resistivity has been adjusted to $1\times10^{8}$ Ω·cm. The secondary transfer roller 11 contacts the intermediate transfer belt 8 at a 50 N pressing force, and rotates in tandem with the rotation of the intermediate transfer belt 8. When the toner on the intermediate transfer belt 8 is being secondary-transferred to a recording material S (e.g. paper), 2500 V of DC voltage (secondary transfer voltage) is applied to the secondary transfer roller 11.

3. Configuration of Belt Cleaner

Figure 3:
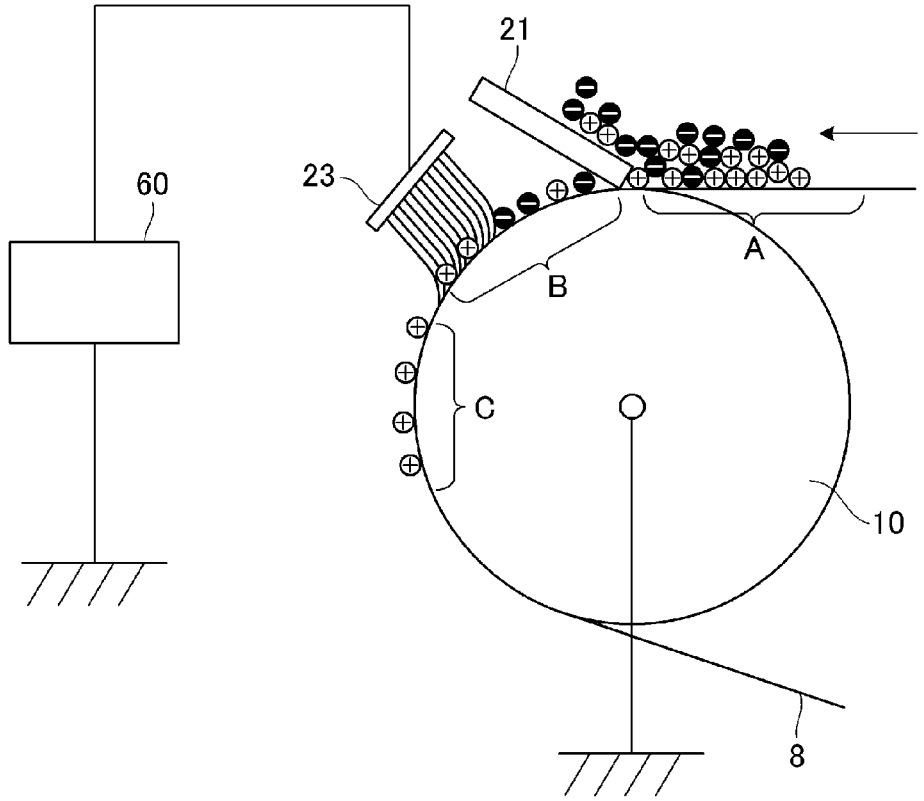
FIG. 3 is a schematic diagram depicting a neighboring area of a belt cleaner according to an example of the present invention.

FIG. 3 is a schematic diagram depicting a neighboring area of the belt cleaner 52 according to this example. In this example, a hybrid type cleaner configuration is used for the belt cleaner 52. The belt cleaning blade 21, used as the contact member (cleaning member), is disposed upstream in the moving direction of the intermediate transfer belt 8, so as to scrape off (remove) most of the toner on the intermediate transfer belt 8. Then toner that passed the belt cleaning blade 21 (hereafter called "pass-through toner") is charged by the conductive brush 23 which is used as the charging unit and which is disposed downstream in the moving direction of the intermediate transfer belt 8. The belt cleaning blade 21 and the conductive brush 23 are pressed against the tension roller 10 via the intermediate transfer belt 8.

The belt cleaning blade 21 is a plate member made of an elastic material. In this example, a plate member made of polyurethane rubber as the elastic material is used for the belt cleaning blade 21. In concrete terms, in this example, a plate member, of which longer side length (or length in the longitudinal direction) is 232 mm, shorter side length (or length in the direction orthogonal to the longitudinal direction) is 12 mm and thickness is 2 mm, is used for the belt cleaning blade 21. This belt cleaning blade 21 presses against the intermediate transfer belt 8 at about 0.49 N/cm linear pressure in the opposite direction of the moving direction R2 of the intermediate transfer belt 8. In other words, the belt cleaning blade 21 contacts the intermediate transfer belt 8 such that the free end side of the belt cleaning blade 21, in the shorter side (approximately orthogonal to the longer side), faces upstream in the moving direction of the intermediate transfer belt 8 along the entire length of the longer side of the blade (approximately orthogonal to the moving direction R2 of the intermediate transfer belt 8).

Of the components of the belt cleaning blade 21, an edge portion of the free end on the intermediate transfer belt 8 side and/or the surface in a predetermined range from the edge portion on the fixed end side contact(s) the surface of the intermediate transfer belt 8. The linear pressure of the belt cleaning blade 21 is preferably 0.4 to 0.8 N/cm, more preferably 0.55 to 0.67 N/cm, in order to implement good cleaning performance and to prevent damage to the blade and belt caused by an excessive pressing force. The "linear pressure of the belt cleaning blade 21" here refers to the contact pressure of the belt cleaning blade 21 on the intermediate transfer belt 8 per unit length. This linear pressure can be determined by installing a load convertor on the intermediate transfer belt 8, pressing the belt cleaning blade 21 against the surface of the intermediate transfer belt 8, and measuring the load thereof.

The conductive brush 23 (charging member) is a brush member constituted by conductive fibers. A predetermined voltage is applied to the conductive brush 23 from a charging bias power supply (high voltage power supply) 60 used as a toner charging voltage applying unit.

Figure 4A:
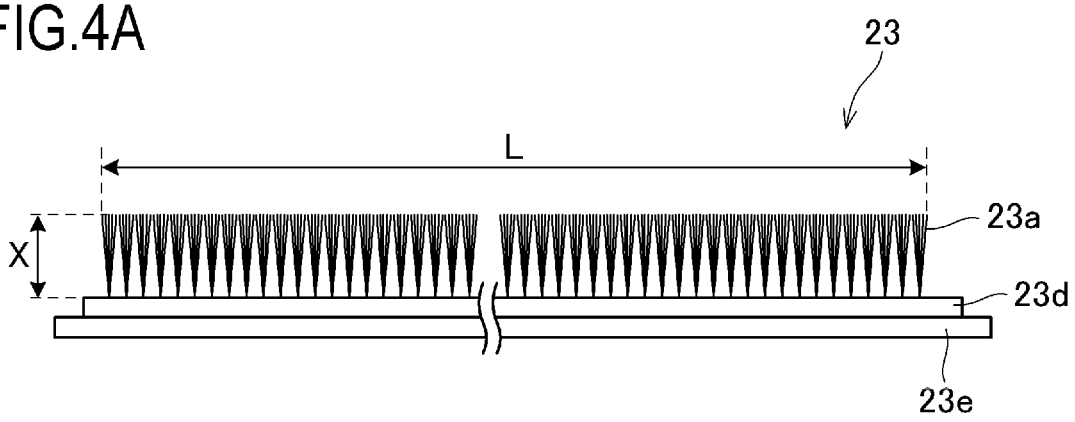
FIG. 4A and FIG. 4B are schematic diagrams depicting a conductive brush according to an example of the present invention.
Figure 4B:
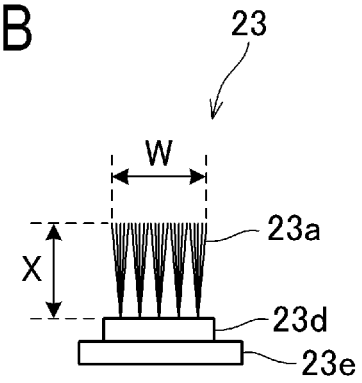

FIG. 4A and FIG. 4B are schematic diagrams depicting the conductive brush 23 in more detail, where FIG. 4A is a view of the conductive brush 23 in the direction orthogonal to the longer side direction, and FIG. 4B is a view of the conductive brush 23 in the longer side direction. In this example, the main component of conductive fibers 23*a* constituting the conductive brush 23 is nylon, and carbon is used as the conducting agent. A resistance value (electric resistance) of one conductive fiber 23*a* per unit length is $1\times10^5$ Ω/cm, and the single yarn fineness is 170 T/68 F. The single yarn fineness in this case refers to one strand of yarn constituted by 68 filament fibers, and has a weight of 170 T (decitex: weight of 10,000 m of yarn is 170 g).

Figure 5A:
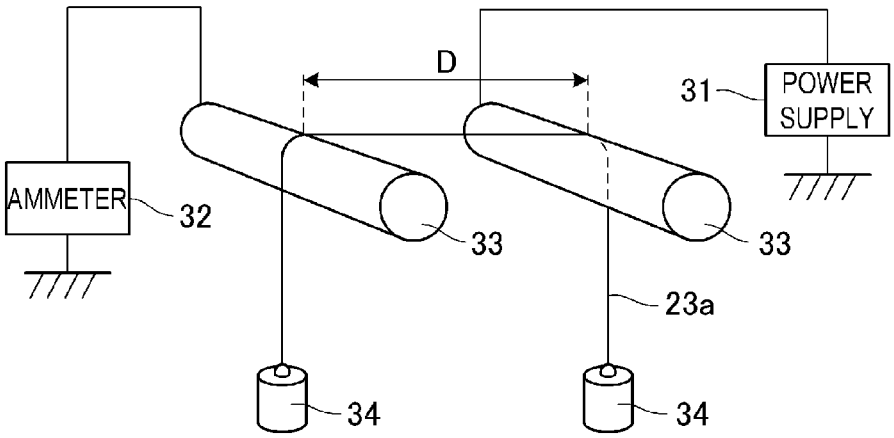
FIG. 5A and FIG. 5B are schematic diagrams depicting a method for measuring resistance values of conductive fiber and the conductive brush.
Figure 5B:
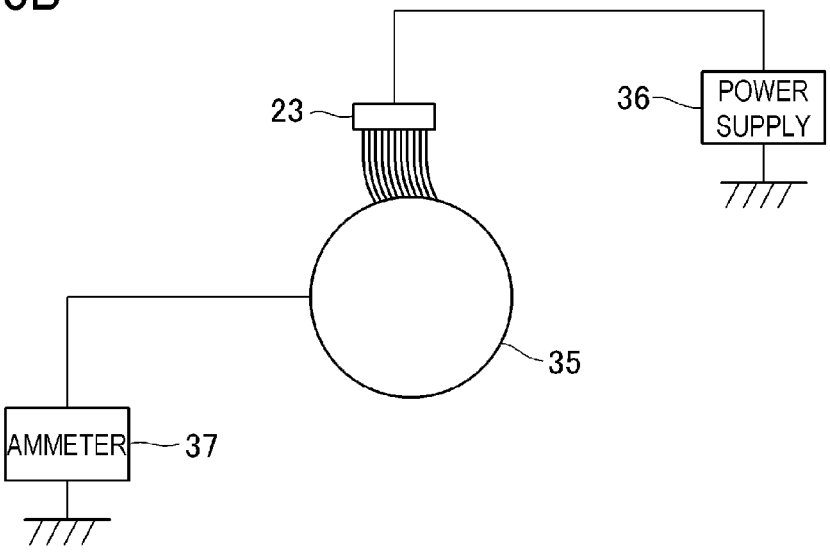

The resistance value of the conductive fiber 23*a* can be determined by the measurement method depicted in FIG. 5A and FIG. 5B. As shown in FIG. 5A, the measurement target conductive fiber 23*a* is stretched between two metal rollers 33 (5 mm diameter) which are disposed with a 10 mm (D) distance, and load is applied to both sides by hanging a 100 g weight 34 on each side. In this state, 200 V of voltage is applied to the conductive fiber 23*a* via one metal roller 33 from the power supply 31. The current value at this time is read by an ammeter 32 connected to the other metal roller 33, and a resistance value (Ω/cm) of the conductive fiber 23*a* per 10 mm (1 cm) is calculated. For the range of the resistance values of the conductive fiber 23*a* per unit length, $1\times10^3$ to $10^7$ Ω/cm is preferable in terms of charging the pass-through toner.

The configuration of the conductive brush 23 will be described next. As shown in FIG. 4A and FIG. 4B, the conductive brush 23, as an assembly of the conductive fibers 23*a* described above, is constituted by the conductive fibers 23*a* which are woven into a base fabric 23*d* made of insulating nylon. The base fabric 23*d* is attached to a support 23*e*, which is a 1 mm thick SUS (stainless steel) metal plate by a conductive adhesive (fixation means). Therefore the conductive fibers 23*a* woven into the base fabric 23*d* contact the support 23*e* under the base fabric 23*d*, and are electrically conductive. In this example, voltage is applied to the conductive brush 23 via the support 23*e*.

In this example, the resistance value (electric resistance) Rb [Ω] of the conductive brush 23 is $1\times10^3$Ω. The density of the conductive fibers 23*a* of the conductive brush 23 is 100 kF/inch$^2$. The length of the conductive fibers 23*a* (vertical distance from the plane of the base fabric 23*d* to the tip of the conductive fibers 23*a*) X is 5 mm. The longer side width of the conductive brush 23 (length between the ends of the edge portion of the conductive fibers 23*a* in the direction approximately orthogonal to the moving direction of the intermediate transfer belt 8) L is 225 mm. The shorter side width of the conductive brush 23 (length between the ends of the edge portion of the conductive fibers 23*a* in the moving direction of the intermediate transfer belt 8) W is 5 mm. The conductive fibers 23*a* of the conductive brush 23 are bundled and implanted in five rows in the moving direction of the intermediate transfer belt 8. The tip positions of the conductive brush 23 are fixed and disposed so that the penetration level to the surface of the intermediate transfer belt 8 is about 1.0 mm. Thereby the conductive brush 23 rubs the surface of the moving intermediate transfer belt 8.

Here the resistance value Rb [Ω] of the conductive brush 23 is determined by the following measurement method. As shown in FIG. 5B, the measurement target conductive brush 23 is contacted with the 30 mm diameter metal roller 35 at 0.9 mm penetration level, and a 200 V voltage is applied from the power supply 36 to the conductive brush 23. The current value at this time is read by the ammeter 37 connected to the metal roller 35, and the resistance value [Ω] of the conductive brush 23 is calculated. The resistance value Rb of the conductive brush 23 is Rb=$1\times10^1$ to $10^5$Ω in the case of the conductive brush 23 using the above mentioned conductive fibers 23*a*, of which resistance value of a unit length is in a ($1\times10^3$ to $10^7$ Ω/cm) range.

The resistance value (electric resistance) Ri [Ω] of the intermediate transfer belt 8 in the portion where the intermediate transfer belt 8 and the conductive brush 23 contact is determined as follows. The surface area of the portion where the intermediate transfer belt 8 and the conductive brush 23 contact is approximately 5 mm×225 mm, since the shorter side width W of the conductive brush 23 is 5 mm and the longer side width L is 225 mm. The thickness of the intermediate transfer belt 8 is 70 μm. Therefore the resistance value Ri of the intermediate transfer belt 8 in the portion where the intermediate transfer belt 8 and the conductive brush 23 contact is $1\times10^{10}$ Ω·cm×70 μm/(5 mm×225 mm)=$6.2\times10^{6}$Ω based on the volume resistivity of the intermediate transfer belt. The resistivity Ri of the intermediate transfer belt 8 is in an Ri=$6.2\times10^{5}$ to $6.2\times10^{7}$Ω range if the intermediate transfer belt 8 in the above mentioned volume resistivity range is used.

The penetration level of the conductive brush 23 to the intermediate transfer belt 8 (or the above mentioned metal roller 35) is represented by the following distance. That is, the distance between the position where the tips of the conductive fibers 23*a* should be (when it is assumed that the brush is not deformed) and the surface of the intermediate transfer belt 8 along the normal direction is the penetration level at the center position of the conductive brush 23.

4. Image Forming Process by Image Forming Apparatus

In an image forming process by the image forming apparatus of the present invention, a process of forming a print image on a recording material S (hereafter called "print image formation") will be described first (image forming step).

First the outer peripheral surface of the rotating photosensitive drum 1 is charged to a predetermined potential having a predetermined polarity (negative polarity in this example) by the primary charging roller 2 to which the primary charging voltage having a predetermined polarity (negative polarity in this example) is applied. Then the surface of the charged photosensitive drum 1 is exposed by the laser unit 3 based on the image signals. Thereby an electrostatic latent image (electrostatic image) is formed on the photosensitive drum 1.

This electrostatic latent image is developed (visualized) as a toner image by the developing assembly 4 using toner as a developer. At this time, a development voltage having a predetermined polarity (negative polarity in this example) is applied to the developing roller 41. In this example, a toner image is formed on the photosensitive drum 1 by image exposure and reversal development. In other words, by exposing the uniformly charged photosensitive drum 1, toner, which is charged to the same polarity as the charging polarity of the photosensitive drum 1, is attached to the exposed portion of the photosensitive drum 1, of which absolute value of the potential has dropped, whereby a toner image is formed. In this example, toner used for development is charged to negative polarity. In other words, the charging polarity of the toner during development is negative polarity.

As described above, the toner image formed on the rotating photosensitive drum 1 is transferred, via the primary transfer unit N1, onto the intermediate transfer belt 8 which is in contact with the photosensitive drum 1 and is rotating at approximately the same rotation speed as the photosensitive drum 1 (primary transfer). At this time, primary transfer voltage having a reversed polarity of the charging polarity of the toner during development (the reversed polarity is a positive polarity in this example) is applied from the primary transfer high voltage power supply 51 used as the primary transfer voltage applying unit.

When a full color image is formed, for example, a toner image formed on each photosensitive drum 1Y, 1M, 1C and 1K of the first, second, third and fourth image forming units PY, PM, PC and PK is transferred onto the intermediate transfer belt 8 such that each toner image is superimposed sequentially. When four color toner images are superimposed, the toner image in this state is conveyed to the secondary transfer unit N2 by the rotation of the intermediate transfer belt 8.

On the other hand, a recording material S, such as recording paper, fed from a feeding/conveying apparatus 12, is conveyed to the secondary transfer unit N2 by a resist roller pair 16. The feeding/conveying apparatus 12 has a feeding roller 14 configured to feed a recording material S from a cassette 13 containing recording materials S, and a conveying roller pair 15 configured to convey the fed recording material S. The recording material S conveyed by the feeding/conveying apparatus 12 is conveyed to the secondary transfer unit N2 by the resist roller pair 16, so as to synchronize with the toner image on the intermediate transfer belt 8.

In the secondary transfer unit N2, the toner image on the intermediate transfer belt 8 is transferred onto the recording material S, which is conveyed in a state of being held between the intermediate transfer belt 8 and the secondary transfer roller 11 (secondary transfer). At this time, secondary transfer voltage having a reversed polarity of the charging polarity of toner during development (the reversed polarity is a positive polarity in this example) is applied to the secondary transfer roller 11 from the secondary transfer power supply 53 used as a secondary transfer voltage applying unit.

The recording material S, on which the toner image is transferred, is conveyed to a fixing apparatus 17 used as a fixing unit. The recording material S is heated and pressed while being conveyed in a state of being held between a fixing film 18 and a pressure roller 19 of the fixing apparatus 17, whereby the toner image is fixed to the surface of the recording material S. The recording material S, on which the toner image is fixed, is ejected from the apparatus main body 110 by an ejecting roller pair 20.

Toner, that remains on the surface of the photosensitive drum 1 after the primary transfer step (primary untransferred toner), is cleaned by the drum cleaner 6. In other words, the primary untransferred toner is scraped off the rotating photosensitive drum 1 by the drum cleaning blade 61, which is disposed in a state of contacting the photosensitive drum 1, and the toner is collected in the waste toner container 62.

The print image forming process of the present invention was described above, but the image forming apparatus of the present invention includes a non-print image forming process (hereafter called "calibration") to form a detection patch image (adjustment-purpose toner image) on the intermediate transfer belt 8 (adjustment step). The calibration is executed for such a purpose as stabilizing toner density of the printed image (image density adjustment purpose) or adjusting a printing position of each color on the intermediate transfer belt 8 (image position adjustment purpose).

Figure 6:
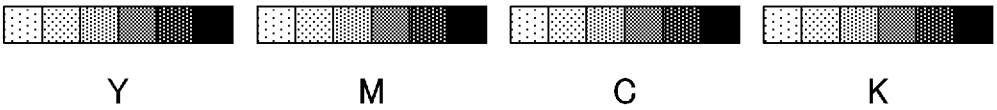
FIG. 6 is a diagram depicting a detection patch of calibration according to an example of the present invention.

In the image forming process for calibration, a plurality of detection patch images having different color densities are formed on the intermediate transfer belt 8, for example, as shown in FIG. 6. Then the density of the patch image is detected by the density sensor 27 located downstream of a fourth image forming unit PK in the moving direction of the intermediate transfer belt 8, and the result is reflected in various settings in the image forming step. For example, toner density is stabilized by making the developing bias value to be supplied to the developing assembly 4 and the exposure start timing of each exposure apparatus 3 adjustable. During this calibration, a secondary transfer voltage having negative polarity, which is the same polarity as the toner, is being applied to the secondary transfer roller 11 in order to prevent the attachment of toner to the intermediate transfer belt 8.

5. Intermediate Transfer Belt Cleaning Step

A step of cleaning the intermediate transfer belt 8 according to this example, after executing the above two image forming processes, will now be described. The image forming apparatus 100 according to this example is configured such that the hybrid system cleaning method (method combining the cleaning by a cleaning member and electrostatic cleaning step using a charging member) can be executed. The image forming apparatus 100 according to this example includes the belt cleaning blade 21 disposed downstream of the secondary transfer roller 11 in the moving direction (conveying direction) of the intermediate transfer belt 8. Most of the toner on the intermediate transfer belt 8 is scraped off the intermediate transfer belt 8 by the belt cleaning blade 21 in the cleaning processing, and is collected in the waste toner container 22. Toner that passed the belt cleaning blade 21 is charged to a reversed polarity of the charging polarity of the toner during development, by the conductive brush 23 used as a charging unit (charging member), which is disposed downstream in the moving direction of the intermediate transfer belt 8.

In the print image forming process, most of the toner on the intermediate transfer belt 8 is transferred to the recording material S after the secondary transfer is performed, hence the toner amount per unit area is very low, and the charge amount is also low since voltage having reversed polarity is applied during the secondary transfer. For example, in the case of the toner used in this example, the charge amount on the intermediate transfer belt 8, after the primary transfer, is about −25 to −35 μC/mg. On the other hand, the charge amount of toner on the intermediate transfer belt 8, after the secondary transfer, drops to about −5 μC/mg, since about 2500 V of secondary transfer voltage is applied. As a consequence, when the print image is formed on the recording material S, the brush current amount required for the conductive brush 23 to reversely charge the pass-through toner, which remained after scraping by the cleaning blade 21, is also low. In the case of the configuration of this example, about a 600 V charging voltage is applied to supply about a 12.0 μA current, so as to charge the pass-through toner to a reversed polarity.

In the calibration, on the other hand, the above mentioned detection patch image is transferred onto the intermediate transfer belt 8, and is then scraped off by the cleaning blade 21 without being transferred to the recording material S, and is collected in the waste toner collection container 22. Therefore the amount of toner per unit area that attached to the intermediate transfer belt 8 is more than the amount of toner that is scraped off by the cleaning blade 21 after the print image formation. Further, in the secondary transfer unit, the secondary transfer voltage having negative polarity is applied, and no voltage having reversed polarity is applied, hence a charge amount of the toner is maintained high. In the case of the configuration of this example, the charge amount of toner after the primary transfer is maintained at about −25 to −35 μC/mg. Therefore in the cleaning operation when the calibration is performed, the charge amount of toner is high, and the attachment force of toner to the intermediate transfer belt 8 is strong, whereby toner is more likely to pass the cleaning blade 21 compared with the cleaning operation after the print image formation. This means that the brush current amount required for reversely charging the pass-through toner of the detection patch image using the conductive brush 23 is larger than the brush current amount required for reversely charging the pass-through toner in the print image formation. In this example, about a 900 V charging voltage is applied whereby about a 18.0 μA current is supplied and pass-through toner is charged to a reversed polarity.

The toner charged to a reversed polarity by the conductive brush 23 is reversely transferred to the photosensitive drum 1Y by the first image forming unit PY, and is collected. Then the photosensitive drum 1 and the primary transfer roller 5 are separated, and as soon as the voltage applied to the conductive brush 23 stops, the driving of the intermediate transfer belt 8 stops, and the cleaning step of the intermediate transfer belt 8 ends.

6. Toner Discharging Step from Conductive Brush (Characteristic of this Example)

A step of discharging toner from the conductive brush 23 to the intermediate transfer belt 8 (hereafter called "toner discharging"), which is a characteristic of this example, will now be described.

(Necessity of Toner Discharging)

The pass-through toner that passed the cleaning blade 21 is mostly charged to a reverse polarity when entering the conductive brush 23, and is reversely transferred to the photosensitive drum 1Y and collected. However a part of the pass-through toner remains in the original polarity of the toner (negative polarity), and attaches to the conductive brush 23 to which voltage with positive polarity is applied. As long as the amount of the attached toner is low, good images can be continuously formed, even if attached toner remains. However as the amount of the attached toner increases, the charging performance of the conductive brush 23 drops. Therefore in order to maintain the charging performance of the conductive brush 23, it is necessary to execute the toner discharging step to discharge the attached toner.

According to the configuration of this example, if the amount of toner attached to the conductive brush 23 (hereafter called "toner attachment amount") exceeds the following standard A in the print image forming process, the charging performance of the conductive brush 23 drops to a level where faulty cleaning occurs. In other words, this occurs when the toner attachment amount exceeds about 6.2 mg at positions of the detection patches (10 mm×2 locations) of the calibration on the conductive brush 23 (longer side width: L 225 mm×5 mm) (level (A)). The "faulty cleaning" occurs when the pass-through toner in an insufficient reversed charge state passes through the conductive brush 23 and remains on the intermediate transfer belt 8 without being reversely transferred to the photosensitive drum 1Y.

The pass-through toner amount is higher in the calibration than in the print image formation, and in the case of the configuration of this example, about 1.8 mg of toner may attach to the detection patch position on the conductive brush 23. Hence in order to prevent the generation of faulty cleaning after the calibration, about 4.4 mg or less of pass-through toner amount in an area of the detection patch position (level (B)) must be maintained. These levels are shown in the following tables.

TABLE 1

| | |
|---|---|
| Toner attachment amount with which faulty cleaning does not occur in printed image formation | About 6.2 mg or less (level A) |
| Toner attachment amount with which faulty cleaning does not occur due to calibration | About 4.4 mg or less (level B) |
| Toner attachment amount due to calibration | About 1.8 mg |

(Toner Discharging Method)

The pass-through toner attached to the conductive brush 23 is mainly charged to a negative polarity. Therefore the pass-through toner can be discharged from the conductive brush 23 to the intermediate transfer belt 8 by either shutting the charging voltage being applied to the conductive brush 23 off, or by applying a discharging voltage having negative polarity, in the state of driving the intermediate transfer belt 8, for example. According to the configuration of this example, the CPU 26 controls the charging voltage being applied to the conductive brush 23, and alternately switches ON (first control voltage value)/OFF (second control value) in a short cycle, whereby toner is discharged. By turning the charging voltage ON, a small amount of positively charged toner existing on the conductive brush 23 can be discharged. Further by repeating ON/OFF, the penetration level of the conductive brush 23 changes due to electrostatic absorption, and the toner discharging effect can be improved.

As the value of the charging voltage applied to the conductive brush 23 becomes greater, the force to move the positively changed toner becomes stronger. Further, displacement of the conductive brush 23 also increases, hence the discharge efficiency increases. If the value is too great, on the other hand, discharge is generated between the conductive brush 23 and the surface of the intermediate transfer belt 8, and toner is thereby excessively charged. If the charge amount of toner becomes higher, the attachment force to the intermediate transfer belt 8 increases, and toner is more likely to pass by the cleaning blade 21. For this reason, in the configuration of this example, the optimum value is 200 V. The cycle of applying the charging voltage is 0.075 seconds for ON and 0.15 seconds for OFF, based on the time required for starting the power to a desired voltage and shutting down, considering the performance of the voltage applying power supply. In this example, it is assumed that the toner discharging is performed according to the above mentioned method.

Figure 7A:
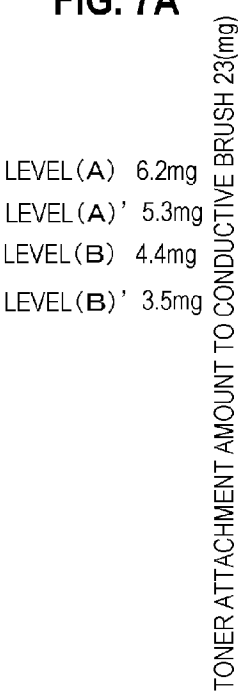
FIG. 7A and FIG. 7B are a diagram depicting the toner discharge step according to Example 1 of the present invention.
Figure 7B:
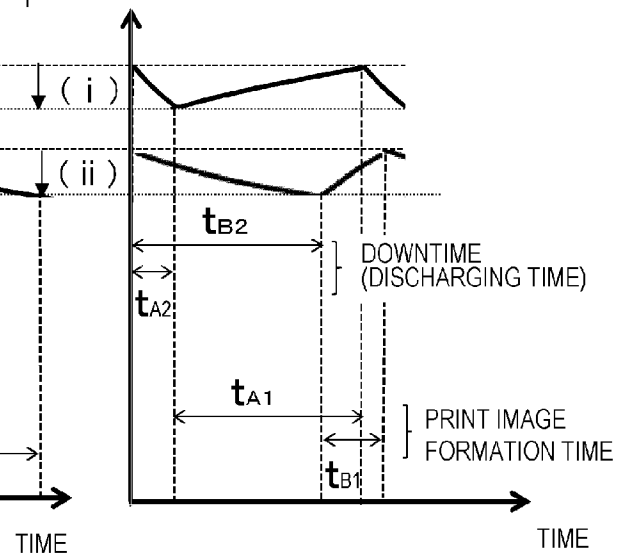

FIG. 7A and FIG. 7B are graphs showing the change of the toner attachment amount when the print page formation is performed using the image forming apparatus of this example, and toner is discharged after toner attaches to level (A). According to the configuration of this example, as shown in the toner attachment portion due to the print image formation in FIG. 7A, the attaching speed of toner is fast while the toner attachment amount is low, and the attaching speed decreases as the attachment amount increases. Furthermore, as shown in the toner discharging portion performed in the discharging step in FIG. 7A, the toner discharging speed is fast while the toner attachment amount is high when the toner is discharged, and the discharge speed tends to decrease if the attachment amount is low.

In FIG. 7A, in the case of (i), which is the case when the print image formation is performed with maintaining level (A) by discharging 0.9 mg of toner from level (A) to level (A)', the print image forming time is indicated by tA1, and the downtime (discharging time) is indicated by tA2. Here the print image forming time is the time interval until the toner is discharged. In the case of (ii), which is the case when the print image formation is performed with maintaining level (B) by discharging 0.9 mg of toner from level (B) to level (B)', the print image forming time is indicated by tB1, and the downtime is indicated by tB2. FIG. 7B is a graph when the changes of toner attachment amount corresponding to the case of (i) and (ii) in FIG. 7A are extracted, and both are compared by vertically placing these graphs in the same time axis.

As FIG. 7B shows, in the image forming apparatus of this example, tA1 is longer than tB1, and tA2 is shorter than tB2. Here the case when the print image formation is performed with maintaining level (A) by discharging 0.9 mg of toner from level (A) to level (A)' and the case when the print image formation is performed with maintaining level (B) by discharging 0.9 mg of toner from level (B) to level (B)', are considered. Compared with the latter case, the print image forming time is longer and downtime is shorter in the former case. Based on this finding, the conditions to execute the toner discharging step of this example and the effect thereof will be described along with comparative examples.

EXAMPLE

Figure 1:
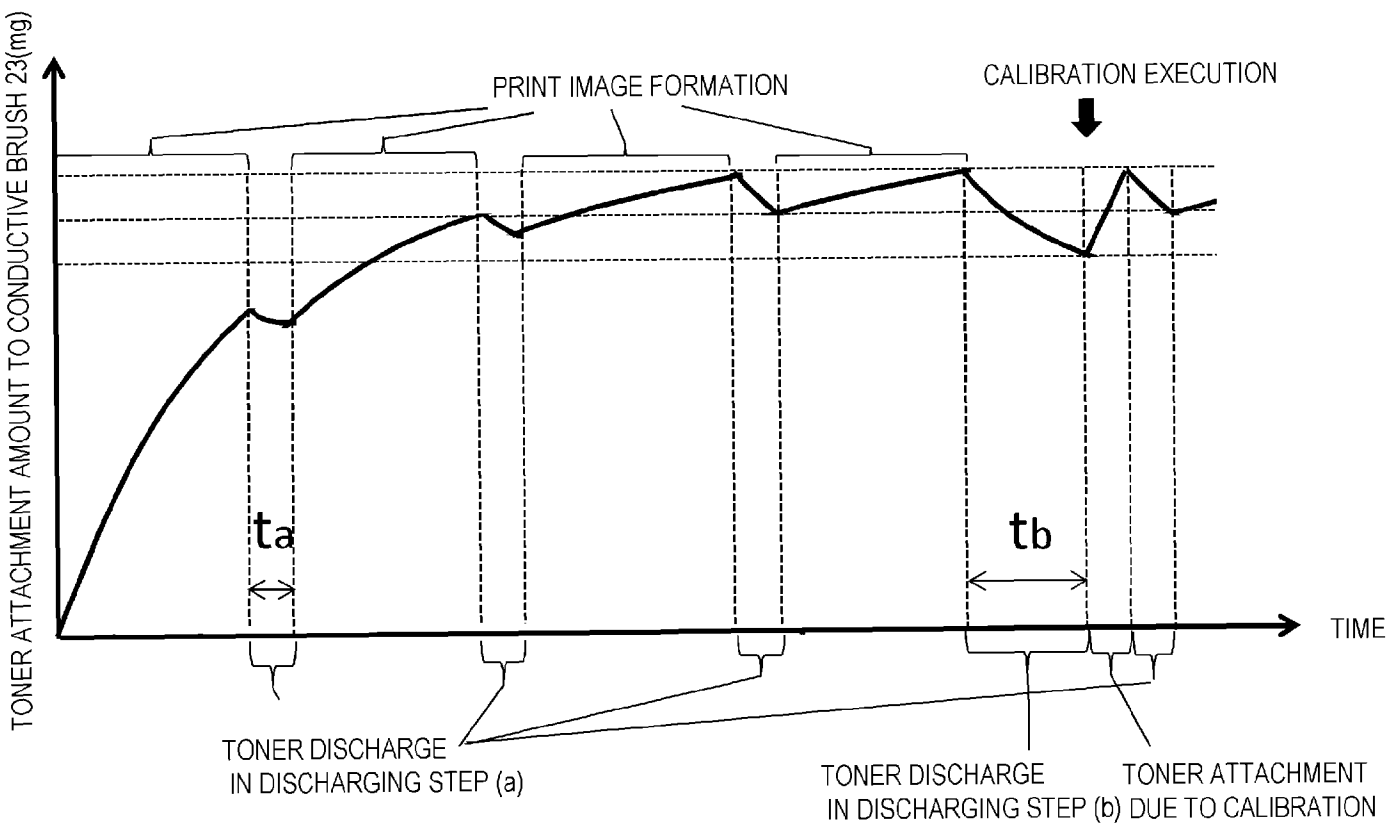
FIG. 1 is a diagram depicting the toner attachment amount on a conductive brush when the control according to Example 1 of the present invention is performed.

FIG. 1 is a graph depicting the change of the toner attachment amount when the image forming operation, including the calibration and the toner discharging step, is performed using the image forming apparatus of this example depicted in FIG. 2. In this example, the toner discharging that is executed before (immediately before) transferring the printing toner for the print image formation to the intermediate transfer belt 8 is called "toner discharging step (a)" (first toner discharging step). By the toner discharging step (a), the toner attachment amount during the print image formation is maintained at level (A) (first limit value) or less. Toner discharging that is executed before (immediately before) transferring the detection patch of the calibration to the intermediate transfer belt 8, on the other hand, is called "toner discharging step (b)" (second toner discharging step). By the toner discharging step (b), the toner attachment amount is discharged to be level (B) (second limit value) or less only before the calibration. In other words, the discharging step is executed such that the toner discharging amount is higher in the toner discharging step (b) than in the toner discharging step (a) (a number of times of switching the state of applying voltage to the conductive brush becomes different).

In the toner discharging step (a), the CPU 26, which is a control unit, counts a number of pages of image formation, and each time 100 pages are counted, the toner discharging is executed after the image forming job is completed, that is, before the printing toner for the next image formation is transferred to the intermediate transfer belt 8. The above mentioned number of times N(a) of repeating ON/OFF of the charging voltage, which is applied to the conductive brush 23, is 8. In other words, the time ta to perform the toner discharging is ta=1.8 seconds. Thereby the toner attachment amount can be maintained at level (A) or less. The toner discharging amount from level (A) in the discharging step (a) is about 0.9 mg in the surface area at the detection patch position.

The toner discharging step (b) is executed next before transferring the detection patch of the calibration is transferred to the intermediate transfer belt 8. The above mentioned number of times N(b) of repeating ON/OFF of the charging voltage, which is applied to the conductive brush 23, is 20, which is higher than the discharging step (a). In other words, the time tb to perform the toner discharging is tb=4.5 seconds. Thereby the toner can be discharged until the toner attachment amount becomes level (B) or less. The toner discharging amount from level (A) in the discharging step (b) is about 1.8 mg in the surface area at the detection patch position.

As shown in FIG. 1, the toner attachment amount can be maintained at level (A) or less during the print image formation, hence good images can be formed continuously. The toner attachment amount does not exceed level (A) even if the calibration is executed, therefore faulty cleaning does not occur.

Comparative Example 1

Figure 8:
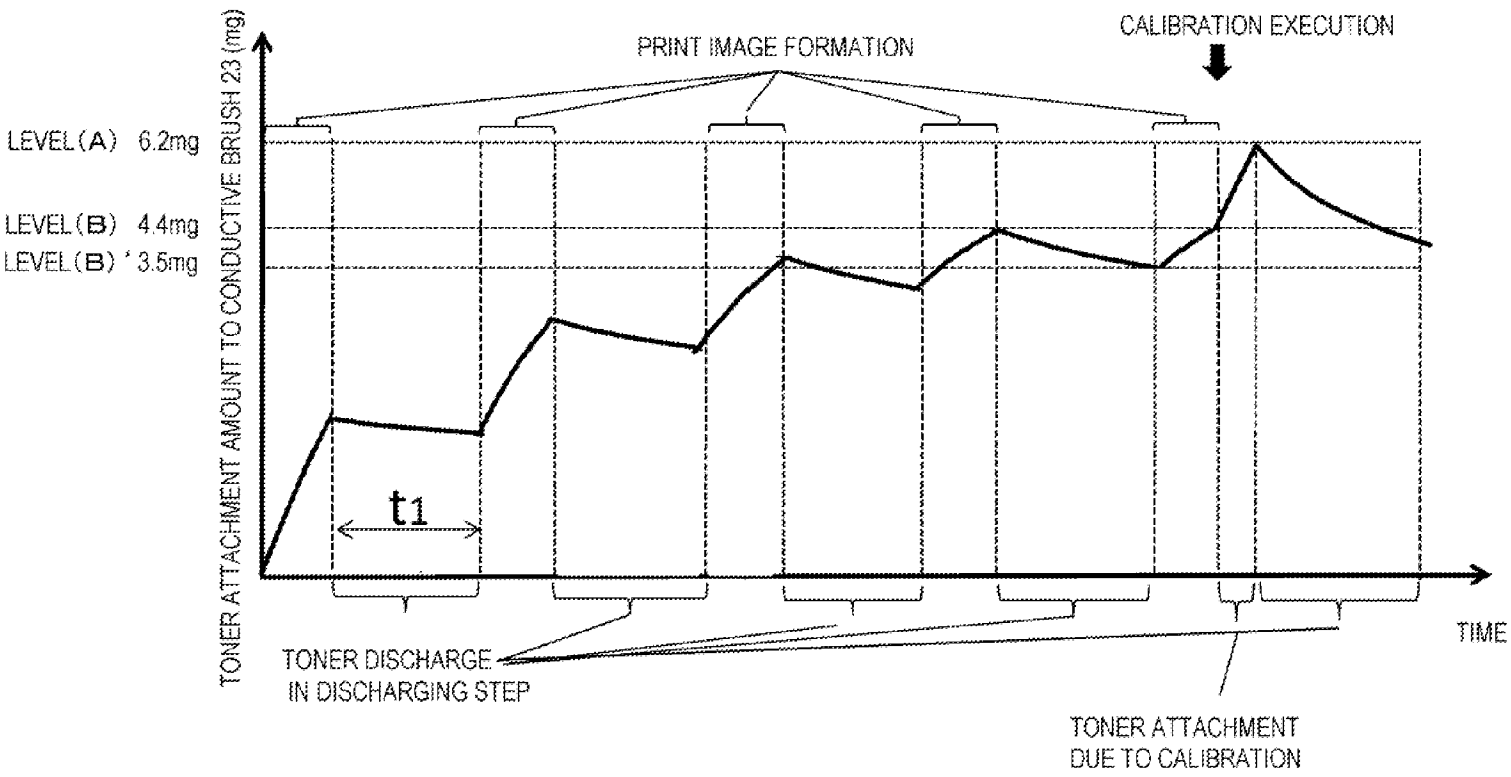
FIG. 8 is a diagram depicting a toner attachment amount on the conductive brush when the control according to Comparative Example 1 is performed.

FIG. 8 is a graph depicting the change of the toner attachment amount when the image forming operation, including the calibration and the toner discharging step, is performed under the conditions of Comparative Example 1. In Comparative Example 1, the toner discharging step is executed with maintaining the toner attachment amount at level (B) or less during the print image formation, so that faulty cleaning does not occur even if the calibration is executed.

In the discharging step of Comparative Example 1, the CPU 26, which is a control unit, counts a number of pages of image formation, and each time 30 pages are counted, the toner discharging is executed after the image forming job is completed. The above mentioned number of times N of repeating ON/OFF of the charging voltage, which is applied to the conductive brush 23, is 28. In other words, the time t1 to perform the toner discharging is t1=6.3 seconds. Thereby the toner attachment amount can be maintained at level (B) or less. The toner discharging amount from level (B) in the discharge step of Comparative Example 1 is about 0.9 mg in the surface area at the detection patch position.

As shown in FIG. 8, the toner attachment amount does not exceed level (A) even during the calibration, hence faulty cleaning does not occur. However compared with this example, the discharging step is executed more frequently during the print image formation, and time to discharge toner is long, which increases downtime. Table 2 shows a result of comparing the image forming apparatus of Example 1, and the Comparative Example 1, in terms of the total time required for the toner discharging (downtime), when forming 5000 pages of print images on recording materials S, and performing the calibration every 1000 pages (total of five times).

TABLE 2

| | Discharging time (downtime) | | |
|---|---|---|---|
| | In print image formation | In calibration | Total |
| Example 1 | 90 seconds | 22.5 seconds | 112.5 seconds |
| Comparative Example 1 | 1045.8 seconds | 0 seconds | 1045.8 seconds |

As shown in Table 2, Example 1 can decrease the downtime generation in the image forming processing in total, compared with Comparative Example 1, since the calibration is performed less frequently during the image formation.

Comparative Example 2

Figure 9:
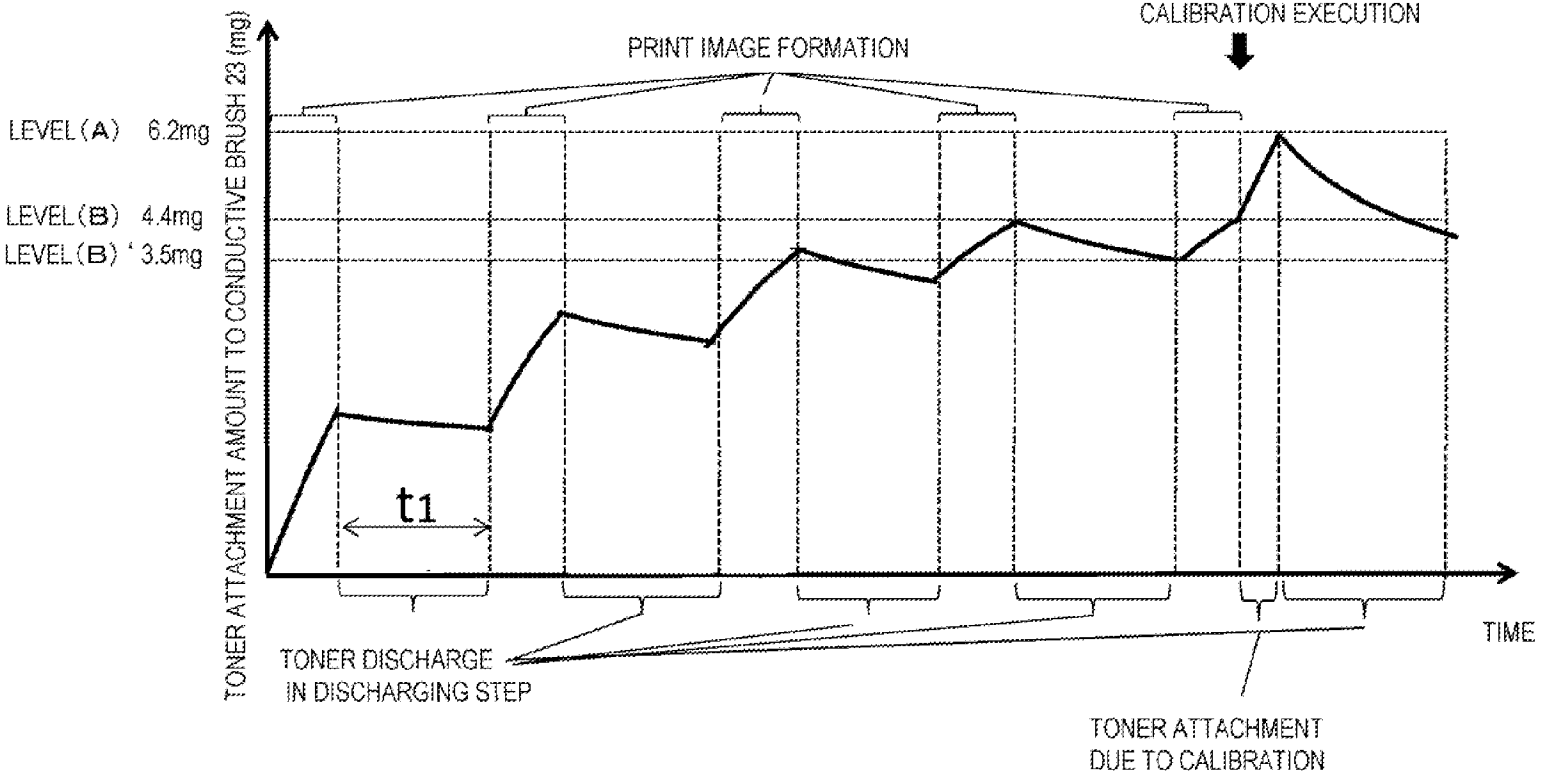
FIG. 9 is a diagram depicting a toner attachment amount on the conductive brush when the control according to Comparative Example 2 is performed.

FIG. 9 is a graph depicting the change of the toner attachment amount when the image forming operation, including the calibration and the toner discharging step, is performed under the conditions of Comparative Example 2. In Comparative Example 2, operation the same as the toner discharging step (a) of this example is performed, and when the calibration is performed, the toner discharging step is executed after the calibration.

As shown in FIG. 9, the toner attachment amount can be maintained at level (A) or less during the print image formation, just like Example 1, hence good images can be formed continuously. However faulty cleaning occurs during the calibration because the toner attachment amount to the conductive brush 23 exceeds level (A). If faulty cleaning occurs during the calibration, and the detection patch image is formed extending two or more cycles of the intermediate transfer belt 8, the pass-through toner of the detection patch image in the first cycle overlaps with the detection patch image in the second cycle, which makes detection inaccurate. As a result, a calibration error occurs.

The toner remaining on the intermediate transfer belt 8 due to faulty cleaning is conveyed to the contact region between the cleaning blade 21 and the intermediate transfer belt 8, and enters the gap of the contact region again where toner previously passed through. At this time, toner is continuously supplied to this gap and remains there, hence once toner passes through a section, toner more easily passes through a subsequent section.

Figure 10:
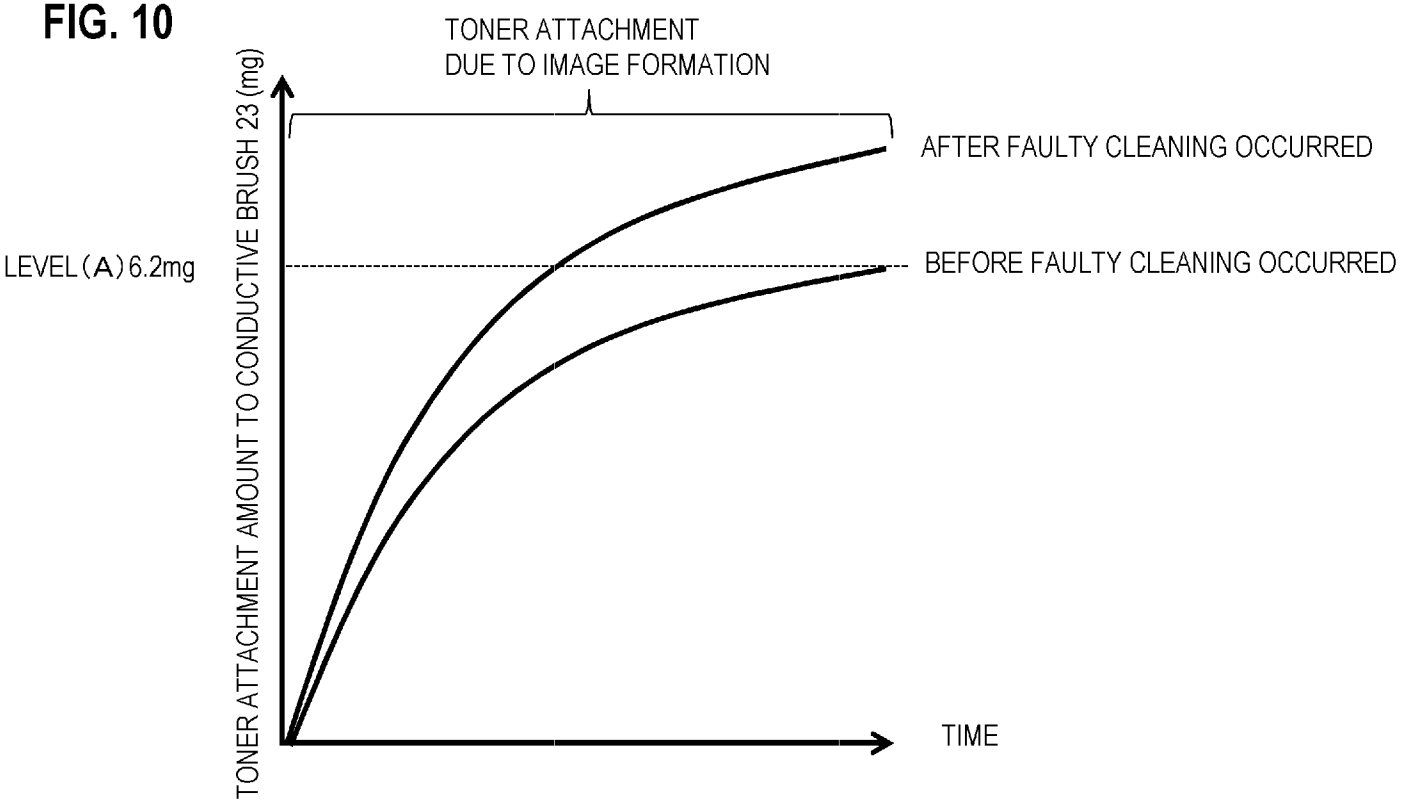
FIG. 10 is a graph depicting a toner attachment amount on the conductive brush before and after faulty cleaning occurred.

FIG. 10 shows the comparison of the toner attachment amount during the print image formation before and after the occurrence of faulty cleaning. As shown in FIG. 10, the attaching speed of toner to the conductive brush 23 increases after the occurrence of faulty cleaning. If the attaching speed of toner increases, the toner discharging must be executed more frequently, which leads to an increase in downtime. Under the conditions of executing the toner discharging step after the calibration, as in the case of Comparative Example 2, a problem is the occurrence of faulty cleaning during the calibration.

Thus far the conditions for executing the toner discharging step according to Example 1 and the effect thereof were described along with comparative examples. If Example 1 is used, the total downtime in the image forming process can be decreased compared with Comparative Example 1. Further, this example has an advantageous configuration in terms of prevention of faulty cleaning during the calibration, compared with Comparative Example 2. Therefore Example 1 has an excellent configuration with which downtime is short, and good cleaning performance can be maintained.

As described above, according to the hybrid system cleaning, the toner discharging step (a) which is performed before the printing toner is transferred onto the intermediate transfer belt, and the toner discharging step (b) which is performed before the detection patch image is transferred onto the intermediate transfer belt, are executed. The discharging operation is executed so that the amount of toner discharged in the toner discharging step (b) is more than the amount of toner discharged in the toner discharging step (a). Thereby downtime can be minimized, and good cleaning performance can be maintained over a long period of time.

In other words, the present invention is for decreasing time for the toner discharging step by utilizing the characteristic in which the toner discharging efficiency is better (discharging amount per unit time increases) as the toner attachment amount on the charging member is higher. In concrete terms, when an image is formed, the toner discharging is controlled so as to allow the attachment of toner to the charging member as much as possible in a range of not causing faulty cleaning.

In calibration (adjustment step), toner is not transferred to the recording material, unlike the image forming step, hence the toner attachment amount is higher than the image forming step. As the toner attachment amount increases, a longer execution time must be taken (number of times of switching the applying voltage must be increased) in the toner discharging step (b) (second toner discharging step) immediately before the adjustment step. Therefore in the second toner discharging step, the toner discharging efficiency increases as the toner attachment amount is higher. This means that it is preferable to perform the second toner discharging step so that the toner attachment amount immediately before executing the adjustment step becomes a value the same as the limit value (allowable value) or a value close to the limit value at which the toner attachment amount immediately after executing the adjustment step does not generate faulty cleaning in the image forming step. In this example, the second toner discharging step is performed so that the toner attachment amount immediately before executing the adjustment step becomes a second limit value (level (B)), that is, not more than the first limit value (level (A)), at which the toner attachment amount immediately after executing the adjustment step is allowed in the image forming step.

In the image forming step, on the other hand, the toner attachment amount is less than the adjustment step. Therefore the toner discharging step (a), that is performed immediately before the image forming step (first toner discharging step), can be maintained so that the toner attachment amount does not exceed the limit value in a shorter execution time than in the second toner discharging step. In the initial stage where the toner attachment amount is still low, the toner discharging efficiency drops as the time of this stage becomes longer, hence it is efficient in keeping the time short. Then if the toner attachment amount becomes close to the upper limit value of the allowable amount, the toner attachment amount immediately before executing the image forming step is controlled to be lower, so that the toner attachment amount immediately after the end of the image forming step does not exceed the limit value (first limit value), for not causing faulty cleaning. As the toner attachment amount immediately after the end of the image forming step is higher (closer to the limit value), efficiency of the toner discharging step, which is executed thereafter, increases. In this example, time of the first toner discharging step, which is executed immediately before the image forming step (immediately before the adjustment step), is set so that the toner attachment amount at the end of the image forming step performed immediately before the adjustment step, out of the plurality of times of image forming steps, becomes the limit value (first limit value). Then the time of the first toner discharging step, which is executed before this step, is also set to the same value. In terms of simplifying control, it is preferable to set the time (number of times of switching) of each first toner discharging step in the plurality of image forming steps to a same value, as shown in this example. However, the present invention is not limited to this, and the time may be changed depending on the level of the toner attachment amount, for example.

The discharging step (a) may be performed when a plurality of jobs (one job is from start to finish of the image forming operation) are completed, or may be performed when the count of image data, such as the pixel count of the print image, reaches a predetermined count value.

Example 2

An image forming apparatus according to Example 2 of the present invention will be described. In the configuration of the image forming apparatus according to this example, a same composing element as Example 1 is denoted with a same reference symbol, for which description will be omitted. Matters that are not described here are the same as Example 1.

Figure 11:
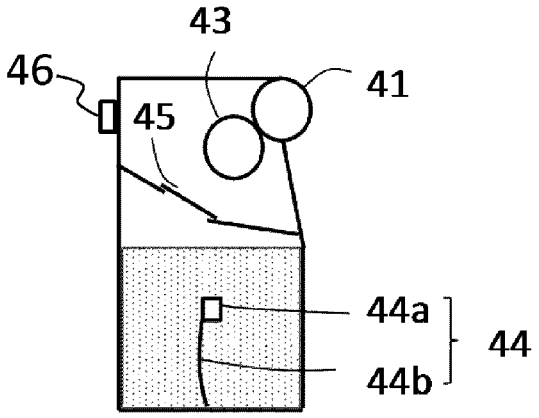
FIG. 11 is a schematic cross-sectional view depicting a process cartridge according to Example 2 of the present invention.

FIG. 11 is a schematic cross-sectional view of a process cartridge 7 according to this example. As shown in FIG. 11, in a developing assembly 4 of a new process cartridge 7, an opening created in a connecting section between a development frame body and a developer frame body, in which toner (developer) is contained, is sealed with a sealing member 45. Thereby leakage of toner is prevented.

In this example, a memory 46 is disposed in the frame body of the developing assembly 4, as a new cartridge detecting unit for detecting the replacement of a process cartridge 7. The location where the memory 46 is disposed is not especially limited, and may be another location in the process cartridge 7. If the process cartridge 7 is installed in the apparatus main body 110, the memory 46 is electrically connected to the control board 25, and the CPU 26 reads the information stored in the memory 46, so as to determine whether the process cartridge 7 is new or not. The new cartridge detection unit is not limited to this configuration. For example, a unit, which is constituted by a recognition unit on the apparatus main body side and an instruction unit on the process cartridge side, and detects a replacement of the process cartridge by the interactions or changes therebetween, (e.g. a push switch and photo-interruptor), may be used.

If the new cartridge detection unit detects a new process cartridge 7, an automatic seal removing step is executed. In the automatic seal removing step, a seal winding member (not illustrated) in the developing assembly 4 winds up the sealing member 45 using the driving force transferred from the image forming apparatus main body, so that the sealing member 45 is removed from within the apparatus main body by winding, without moving the process cartridge 7 outside the body. If the sealing member 45 is removed, toner is conveyed into the development frame body by a toner conveying member 44, which is constituted by a conveying member shaft 44*a* and a conveyance sheet 44*b* inside the developer frame body, and toner can be supplied from the supplying roller (developer supplying member) 43 to the developing roller 41.

Normally in a color image forming apparatus of an electro-photographic system, calibration is executed after a consumable is replaced. In this example, if a new process cartridge 7 is detected, the above mentioned seal removing step is performed, then calibration is executed.

In the case of using a new process cartridge 7, more toner, of which particle diameter is small, tends to be consumed compared with the case of using a process cartridge 7 after being used for a while, hence the charge amount of toner to be developed increases. This is because as the particle diameter of toner becomes smaller, a specific surface area becomes greater and the charge amount increases, and as the particle diameter of toner becomes larger, the charge amount decreases. As a result, when toner is transferred to the developing roller 41 or photosensitive drum 1, transfer by applying voltage more easily occurs in the case of toner of which particle diameter is smaller, that is, the charge amount is higher. For example, in the case of the toner used for the configuration of this example, the charge amount on the intermediate transfer belt 8, after the primary transfer, is about −35 to −45 μC/mg if a new process cartridge is used.

As the charge amount of the toner is higher, the attachment force of the toner to the intermediate transfer belt 8 increases, and the toner more easily passes by the cleaning blade 21. As a result, in the configuration of this example, the toner attachment amount at the detection patch position on the conductive brush 23 must be 4.0 mg or less (level (C)) when the detection patch of the calibration is cleaned using a new process cartridge 7.

Figure 12:
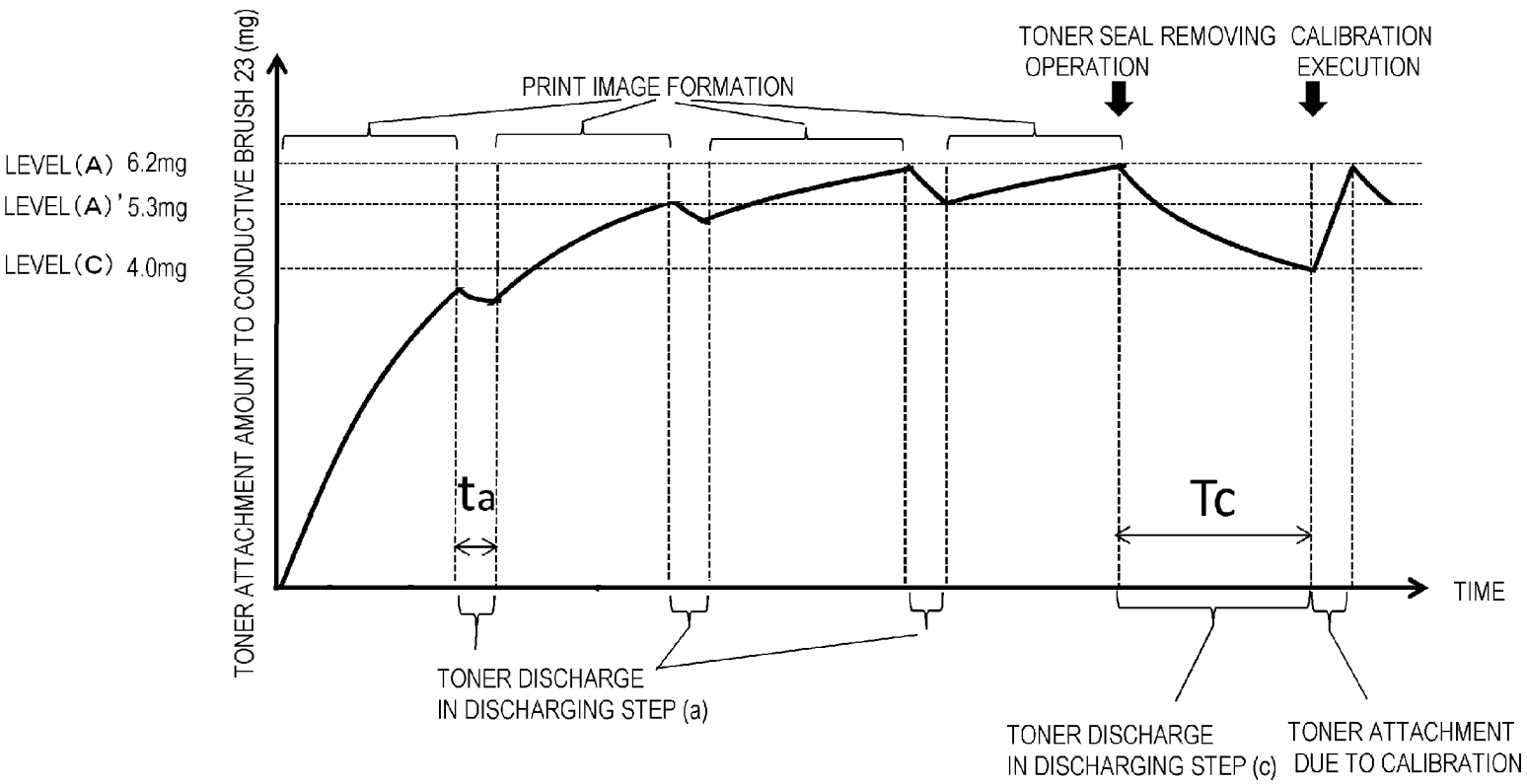
FIG. 12 is a diagram depicting a toner attachment amount on the conductive brush when the control according to Example 2 of the present invention is performed.

FIG. 12 is a graph depicting the change of the toner attachment amount when the image forming operation, including the seal removing step, calibration and toner discharging step, is performed using the image forming apparatus according to Example 2. In this example, the toner attachment amount is decreased to level (C) before the detection patch using a new process cartridge 7 is transferred to the intermediate transfer belt 8, hence the discharging step (c) is executed during the seal removing step, which is performed after detecting that the process cartridge 7 is new. In the discharging step (c), which is executed immediately after detecting the new cartridge (third toner discharging step), the above mentioned number of times N of repeating ON/OFF of the charging voltage that is applied to the conductive brush 23, is 30 times, which is higher than the discharging step (a) and the discharging step (b) of Example 1. In other words, the time tc to execute the toner discharging is tc=6750 milliseconds. Thereby the toner can be discharged until the toner attachment amount becomes level (C) or less. The toner discharging amount in the discharging step (c) is changed from level (A) to about 2.2 mg in the surface area at the detection patch position.

As shown in FIG. 12, the toner attachment amount can be maintained at level (A) or less during the print image formation, which means that good images can be formed continuously. Furthermore, even if the toner discharging step (c) is performed simultaneously with the seal removing step and the calibration is executed, the toner attachment amount does not exceed level (A), therefore print images can be formed without causing faulty cleaning.

As described above, after detecting that the process cartridge 7 is in a new cartridge state, the discharging step (c), to discharge toner from the conductive brush 23, is executed simultaneously with the automatic seal removing sequence. The amount of toner to be discharged in the discharging step (c) is higher than that in the toner discharging step (a) and the toner discharging step (b) in Example 1. Thereby good cleaning performance can be maintained. Furthermore, downtime can be reduced by performing the toner discharging step (a), to discharge toner from the conductive brush 23 in the print image formation, just like the effect of Example 1.

In this example, the amount of toner discharged in the discharging step (c) is more than the discharging step (b), but the present invention is not limited to this. For example, the toner amount to be discharged in the discharging step (c) may be the same as that discharged in the discharging step (b), if the occurrence of faulty cleaning does not change very much, whether a new process cartridge 7 is used or a process cartridge 7 after being used for a while is used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-015804, filed on Jan. 29, 2015, which is hereby incorporated by reference herein in its entirety.

What is claimed is:

1. An image forming apparatus, comprising:

an image bearing member configured to bear a toner image that is formed by an electrostatic latent image being developed using toner;

an intermediate transfer belt configured such that a toner image is transferred from the image bearing member;

a cleaning member configured to remove toner from the intermediate transfer belt by contacting the intermediate transfer belt;

a charging member configured to charge toner borne on the intermediate transfer belt; and a power supply configured to apply voltage, which is required for the charging member to charge toner, to the charging member, wherein the image forming apparatus is configured to execute:

an image forming step in which an image is formed on a recording material by transferring a toner image, which is transferred from the image bearing member to the intermediate transfer belt, to the recording material;

an electrostatic cleaning step in which the power supply applies voltage, which has reversed polarity of the polarity used upon charging toner to develop an electrostatic latent image, to the charging member, and the charging member charges the toner borne on the intermediate transfer belt to have the reversed polarity so that the toner is transferred from the intermediate transfer belt to the image bearing member, and the toner is removed from the intermediate transfer belt;

a toner discharging step in which the power supply changes a state of applying voltage to the charging member from that in the electrostatic cleaning step, so that the toner attached to the charging member is transferred to the intermediate transfer belt; and an adjustment step in which an adjustment-purpose toner image, which is not transferred to a recording material, is formed on the intermediate transfer belt, and the adjustment-purpose toner image is removed from the intermediate transfer belt by the cleaning member and through the electrostatic cleaning step, wherein the adjustment step is executed in a state where a toner attachment amount of the charging member is switched from a first limit value, which is allowed in the image forming step, to a second limit value, which is allowed immediately before executing the adjustment step, by the execution of the toner discharging step.

2. The image forming apparatus according to claim 1, wherein the second limit value is a value by which the toner attachment amount immediately after the end of the adjustment step becomes the first limit value or less.

3. The image forming apparatus according to claim 1, wherein the second limit value is a value lower than the first limit value.

4. The image forming apparatus according to claim 1, wherein the toner discharging step is performed by the power supply alternately switching a state of applying voltage to the charging member between a first state and a second state which is different from the first state, and the number of times when the power supply switches the voltage applying state is less in a first toner discharging step, which is executed immediately before the image forming step, than a second toner discharging step, which is executed immediately before the adjustment step.

5. The image forming apparatus according to claim 4, wherein the adjustment step is executed after executing the image forming step for a plurality of times, and the number of times of switching the voltage applying state in the first toner discharging step is the number of times that allows the toner attachment amount to be maintained so as not to reach the first limit value until the second toner discharging step is executed.

6. The image forming apparatus according to claim 5, wherein the number of times of switching in the first toner discharging step, which is executed immediately before each of the plurality of times of the image forming step, is the same each time.

7. The image forming apparatus according to claim 4, wherein the voltage value which the power supply applies to the charging member is different between the first state and the second state.

8. The image forming apparatus according to claim 4, wherein one of the first state and the second state is a state of the power supply applying voltage to the charging member (ON), and the other is a state of the power supply not applying voltage to the charging member (OFF).

9. The image forming apparatus according to claim 4, wherein the polarity of the voltage which power supply applies to the charging member is different between the first state and the second state.

10. The image forming apparatus according to claim 1, further comprising:

a cartridge configured to be detachable from an apparatus main body of the image forming apparatus, the cartridge including:

the image bearing member;

a developer bearing member configured to bear toner for developing an electrostatic latent image formed on the image bearing member;

a developer supplying member configured to supply toner to the developer bearing member; and a developer container configured to contain toner which the developer supplying member supplies to the developer bearing member; and a detection unit configured to detect that the cartridge is new, wherein the adjustment step, which is initially executed after the detection unit detects that the cartridge is new, is executed in a state where the toner attachment amount is reduced, by the execution of the toner discharging step, to a third limit value or less that is allowed in a state immediately before the execution of the adjustment step which is initially executed.

11. The image forming apparatus according to claim 10, wherein the third limit value is a value by which the toner attachment amount, immediately after the end of the adjustment step initially executed, becomes the first limit value or less.

12. The image forming apparatus according to claim 10, wherein the number of times of the power supply switching the voltage applying state is higher in the third toner discharging step which is executed immediately before the adjustment step initially executed, than in the first toner discharging step which is executed immediately before the image forming step.

13. The image forming apparatus according to claim 10, wherein the number of times of the power supply switching the voltage applying state is higher in the third toner discharging step which is executed immediately before the adjustment step initially executed, than in the second toner discharging step which is executed immediately before the adjustment step which is executed thereafter.

14. The image forming apparatus according to claim 10, wherein the developer container includes:

an opening for feeding the contained toner to the developer supplying member; and a sealing member which seals the opening when the cartridge is new, and which is removed from the opening to open the opening when the new cartridge is installed to the image forming apparatus main body, and the third toner discharging step, which is executed immediately before the adjustment step initially executed, is executed while the sealing member is being removed from the opening.

15. The image forming apparatus according to claim 1, wherein the adjustment-purpose toner image is a toner image for adjusting an image density or for adjusting an image position.

* * * * *